US012747004B2

(12) United States Patent
Liu

(10) Patent No.: US 12,747,004 B2
(45) Date of Patent: Sep. 29, 2026

(54) DOUBLE-CHAMBER INFLATABLE PADDLE BOARD WITH DETACHABLE FUNCTION

(71) Applicant: WEIHAI WINNER INNOVATION OCEAN TECHNOLOGY CO., LTD, Weihai (CN)

(72) Inventor: Peng Liu, Weihai (CN)

(73) Assignee: WEIHAI WINNER INNOVATION OCEAN TECHNOLOGY CO., LTD, Weihai (CN)

( * ) Notice: Subject to any disclaimer, the term of this patent is extended or adjusted under 35 U.S.C. 154(b) by 470 days.

(21) Appl. No.: 18/502,642

(22) Filed: Nov. 6, 2023

(65) Prior Publication Data

US 2024/0262465 A1 Aug. 8, 2024

Related U.S. Application Data

(63) Continuation of application No. PCT/CN2023/079435, filed on Mar. 3, 2023.

(30) Foreign Application Priority Data

Feb. 7, 2023 (CN) ..... 202320178016.6

(51) Int. Cl.
*B63B 32/51* (2020.01)
*B63B 32/40* (2020.01)
*B63B 32/60* (2020.01)

(52) U.S. Cl.
CPC ..... *B63B 32/51* (2020.02); *B63B 32/40* (2020.02); *B63B 32/60* (2020.02)

(58) Field of Classification Search
CPC ..... B63B 32/40; B63B 32/51; B63B 32/60; B63B 32/00
See application file for complete search history.

(56) References Cited

U.S. PATENT DOCUMENTS 12,377,939 B2 * 8/2025 Huang ..... B63B 7/08

FOREIGN PATENT DOCUMENTS

| | | | | |
|---|---|---|---|---|
| CN | 109733548 A | | 5/2019 | |
| CN | 111532383 A | | 8/2020 | |
| CN | 212921897 U | | 4/2021 | |
| CN | 213620155 U | | 7/2021 | |
| CN | 217864605 U | | 11/2022 | |
| EP | 2808245 A1 | * | 12/2014 | ..... B63B 32/40 |
| EP | 3689735 A1 | * | 8/2020 | ..... B63B 32/51 |
| FR | 3113279 A3 | | 2/2022 | |

* cited by examiner

*Primary Examiner* — Ajay Vasudeva
(74) *Attorney, Agent, or Firm* — Scully, Scott, Murphy & Presser, P.C.

(57) ABSTRACT

A double-chamber inflatable paddle board with detachable function includes an outer chamber, an inner chamber and a fixing connector strip. The outer and inner chambers are independent chambers. A middle portion of the outer chamber includes an opening with an accommodating cavity that matches the inner chamber. One side of the fixing connector strip is fixedly connected to one of an inner edge of the outer chamber and an outer edge of the inner chamber, and the other side is suspended. In an inflated state, the other side of the fixing connector strip is engaged on one of the outer edge of the inner chamber and the inner edge of the outer chamber, to cooperate with the connected chamber to form an inflatable paddle board product with flat surface. The inner and outer chambers are detachably connected into one piece through the fixing connector strip.

9 Claims, 3 Drawing Sheets

DOUBLE-CHAMBER INFLATABLE PADDLE BOARD WITH DETACHABLE FUNCTION

RELATED APPLICATION

This application is a continuation application of PCT Application Serial No. PCT/CN2023/079435, filed on Mar. 3, 2023, which claims priority to Chinese Patent Application No. 202320178016.6, filed on Feb. 7, 2023, the content all of which is herein incorporated by reference in their entirety.

TECHNICAL FIELD

The present disclosure relates to the technical field of water transportation tools, in particular to a double-chamber inflatable paddle board with detachable function.

BACKGROUND

Paddle surfing, originating from Hawaii in the United States, has become a globally popular sport in recent years. The main material of the paddle board is a new type of material made by adhering space fabric and netting fabric, which has the advantages of portability, foldable storage, high support strength, and the like.

At present, the paddle boards on the market are mainly the ones with single chamber, with fewer ones with two-chamber. The paddle board with single chamber itself does not have a safety prevention function, and can only rely on strict requirements of the manufacturing process to ensure the safety of users. However, the structure of the existing paddle board with two-chamber is unreasonable. The structure of the existing paddle board with two-chamber mostly divides the main material of the paddle board into two chambers from the center, and then uses two inner layer airtight strips thermal pressed together in advance, which are respectively bonded to cut parts of the two chambers, to form a two-chamber structure with two chambers each tightly sealed. The paddle board with two-chamber of this structure has many defects. For example, firstly, due to the hard inner sealing strips that have already been thermally pressed, it is difficult for a bonded chamber being bonded to another space fabric to be bonded, resulting in a high defect rate of the finished products: secondly, after the finished product is produced, although the two chambers are independent, they are actually bonded together, which means that, in the event of one chamber leaking, the leaking chamber will be a burden on the other chamber, reducing the safe buoyancy of the other chamber: thirdly, once one of the inflated chambers leaks, the other chamber will experience a curving trend due to the special width of the inner airtight strip and changes in the force at the bonding point, resulting in tearing of the inner tensile fibers of the space fabric, which is prone to chamber collapse and poses a safety hazard. It can be seen that the existing paddle board with two-chamber not only has the disadvantages of complex manufacturing process and high defect rate, but also has the disadvantages of poor practicality and low safety.

Therefore, in order to ensure the safety of users on water, there is an urgent need for a new type of structure of inflatable paddle board with two chambers, so that even if one chamber leaks, the other chamber can reliably protect the users back to the shore smoothly.

SUMMARY

The purpose of the present disclosure is to provide a double-chamber inflatable paddle board with detachable function, so as to solve the problems of unreasonable structure, complex manufacturing process, poor practicality, and high safety hazards of the structure of the existing paddle board with two-chamber.

The implementation of the present disclosure can be achieved through the following technical solutions.

A double-chamber inflatable paddle board with detachable function, which is including an outer chamber, an inner chamber and a fixing connector strip, wherein the outer chamber and the inner chamber are both independent chambers, a middle portion of the outer chamber includes an opening with an accommodating cavity that matches the inner chamber, the inner chamber is detachably connected to the outer chamber through the fixing connector strip, wherein one side of the fixing connector strip is fixedly connected to one of an inner edge of the outer chamber and an outer edge of the inner chamber, the other side of the fixing connector strip is suspended and cooperates with the connected chamber to form a snap-fit connection frame, in an inflated state, the other side of the fixing connector strip is engaged on one of the outer edge of the inner chamber and the inner edge of the outer chamber.

Further, the fixing connector strip has a strip-like structure with a wide top and a thin bottom, a tip of the fixing connector strip is connected to a joint between the outer chamber and the inner chamber, and the top of the fixing connector strip is connected to surfaces of the outer chamber and the inner chamber.

Further, in a width direction of the fixing connector strip, a cross-section of the fixing connector strip is approximate triangle, and two sides of the fixing connector strip connected to the chambers are in an arc shape.

Further, a number of the fixing connector strip is two, and the two fixing connector strips are respectively located in upper and lower directions of mating surfaces between the outer chamber and the inner chamber.

Further, the fixing connector strip is made of polyvinyl chloride material.

Further, the outer chamber includes an outer chamber body, a first sealing strip and a second sealing strip, periphery sides of the outer chamber body are sealed by the first sealing strip, an inner side of the outer chamber body is sealed by the second sealing strip, the outer chamber body, the first sealing strip and the second sealing strip together enclose and form an independent chamber with the accommodating cavity.

Further, the accommodating cavity is a through hollow cavity that runs vertically, and the second sealing strip is sealed on the inner side of the outer chamber body along a circumference of the accommodating cavity.

Further, the inner chamber includes an inner chamber body and a third sealing strip, periphery sides of the inner chamber body are sealed by the third sealing strip, the inner chamber body and the third sealing strip together enclose and form an independent chamber.

Further, the accommodating cavity is located at the inner edge of the outer chamber, and the third sealing strip is located at the outer edge of the inner chamber.

Further, each of the outer chamber and the inner chamber is provided with an independent air nozzle.

The embodiments of the present disclosure provide a double-chamber inflatable paddle board with detachable function that has at least the following beneficial effects:

1. The inner chamber and the outer chamber of the present disclosure are detachably connected together through a fixing connector strip. When one of the chambers leaks, the leaking chamber can easily detach from the other chamber, and the leaking chamber will not become a burden on the other chamber, ensuring the safe buoyancy of the other chamber, and allowing users to safely back to the shore with the other chamber. In addition, users can combine two chambers into a complete inflatable paddle board by replacing only the leaking chamber afterwards, without the need to replace the entire inflatable paddle board due to one of the chambers leaking. It has the advantages of reasonable structure, high safety, good replaceability and good practicality.

2. The fixing connector strip of the present disclosure has a hard strip-like structure with a wide top and a thin bottom. The tip of the fixing connector strip is connected to the joint between the outer chamber and the inner chamber, and the top is connected to the surfaces of the outer chamber and the inner chamber. Such a connection method increases the firmness of the connection between the inner chamber and the outer chamber, effectively avoids the separation of the inner and outer chambers of the inflatable paddle board under normal use state. It has advantages such as high safety and good practicality.
3. The inner and outer chambers of the present disclosure are two independent chambers, and the inner chamber is detachably connected to the accommodating cavity of the outer chamber through the fixing connector strip, so that the two independent chambers can be separated for leak detection in an early stage of production. There is no need to bond the two chambers together through inner layer airtight strip before conducting leak detection, which effectively reduces the leakage defect rate of the finished products. The present disclosure has the advantages of simplified manufacturing processes, low production costs, and high yield of products.

REFERENCE LIST

Figure 1:
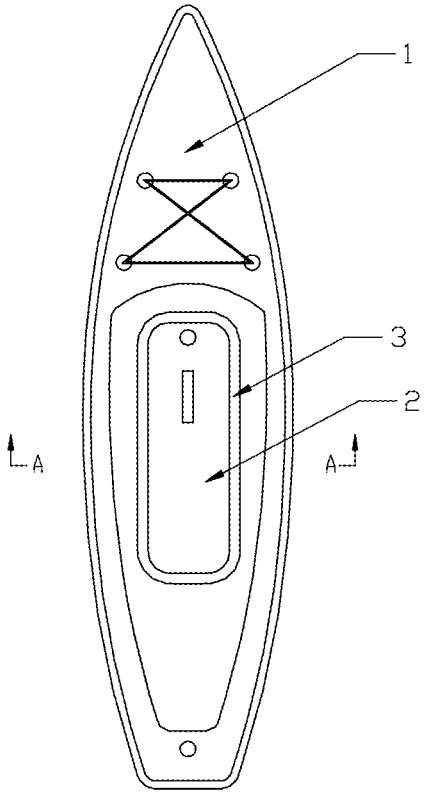
FIG. 1 is a schematic diagram of a double-chamber inflatable paddle board with detachable function in a combined state in Embodiment 1.

1, outer chamber: 11, outer chamber body: 12, first sealing strip: 13, second sealing strip: 14, first air nozzle: 2, inner chamber: 21, inner chamber body: 22, third sealing strip: 23, second air nozzle: 3, fixing connector strip: 4, accommodating cavity: 5, snap-fit connection frame: F, joint.

DESCRIPTION OF EMBODIMENTS

The present disclosure will be further explained based on the preferable embodiments and with reference to the accompanying drawings.

In addition, for the convenience of understanding, various components on the drawing have been enlarged (thickened) or reduced (thinned), but this practice is not intended to limit the scope of protection of the present disclosure.

Words in the singular form also include the plural, and vice versa.

As described in Background, the structure of the existing paddle board with two-chamber is unreasonable, the manufacturing process is complex, the safety is insufficient, and the practicality is poor. To solve the above technical problems, the present disclosure creatively provides a double-chamber inflatable paddle board with detachable function that is different from the existing technology.

Specifically, please refer to FIGS. 1 to 6 for a double-chamber inflatable paddle board with detachable function, which includes an outer chamber 1, an inner chamber 2 and a fixing connector strip 3. The outer chamber 1 and the inner chamber 2 both are independent chambers, and an accommodating cavity 4 matched with the inner chamber 2 includes an opening in the middle portion of the outer chamber 1. The inner chamber 2 and the outer chamber 1 are detachably connected together through the fixing connector strip 3.

One side of the fixing connector strip 3 is fixedly connected to an inner edge of the outer chamber 1 or an outer edge of the inner chamber 2, the other side of the fixing connector strip 3 is suspended and cooperates with the connected chamber to form a snap-fit connection frame 5. In an inflated state, the other side of the fixing connector strip 3 is in a snap-fit connection with the outer edge of the inner chamber 2 or the inner edge of the outer chamber 1.

The inner chamber 2 is engaged in the accommodating cavity 4 of the outer chamber 1 due to the limiting effect of the fixing connector strip 3, thus cooperates with the connected chamber to form an inflatable paddle board product with flat surface. When one of the chambers leaks, the leaking chamber can easily detach from the other chamber, and the leaking chamber will not become a burden on the other chamber, ensuring the safe buoyancy of the other chamber. This allows the user to safely back to the shore with the other chamber, resulting in the advantages of reasonable structure and higher safety. In addition, the users can combine two chambers into one complete inflatable paddle board by only replacing the leaking chamber afterwards, without the need to replace the entire inflatable paddle board due to one of the chambers leaking, making it more practical.

In the description of the embodiments of the present disclosure, it should be noted that if the orientation or positional relationship indicated by the terms "up", "down", "inside", "outside" or the like is based on the orientation or positional relationship shown in the drawings, or is the orientation or positional relationship commonly placed when using the products of the embodiments of the present disclosure. It is only for the convenience of describing the present disclosure and simplifying the description, rather than indicating or implying that the device or component referred to must have a specific orientation, be constructed and operated in a specific orientation, therefore it cannot be understood as a limitation to the present disclosure. In addition, in the description of the present disclosure, in order to distinguish different units, terms such as "first" and "second" are used in this specification. However, these terms are not limited by the order of manufacturing and cannot be understood as indicating or implying relative importance. Their names may differ in the detailed description and claims of the present disclosure.

The vocabulary herein is used to illustrate embodiments of the present disclosure, but is not intended to limit the present disclosure. It should also be noted that unless otherwise specified and limited, the terms "provide", "couple" and "connect" should be broadly understood, such as fixed connections, detachable connections, or integrated connections: it can be a mechanical connection, a direct connection, or an indirect connection through an intermediate medium, or an interior connection between two components. For those skilled in the art, they can specifically understand the specific meanings of the above terms in the present disclosure.

Embodiment 1

Figure 2:
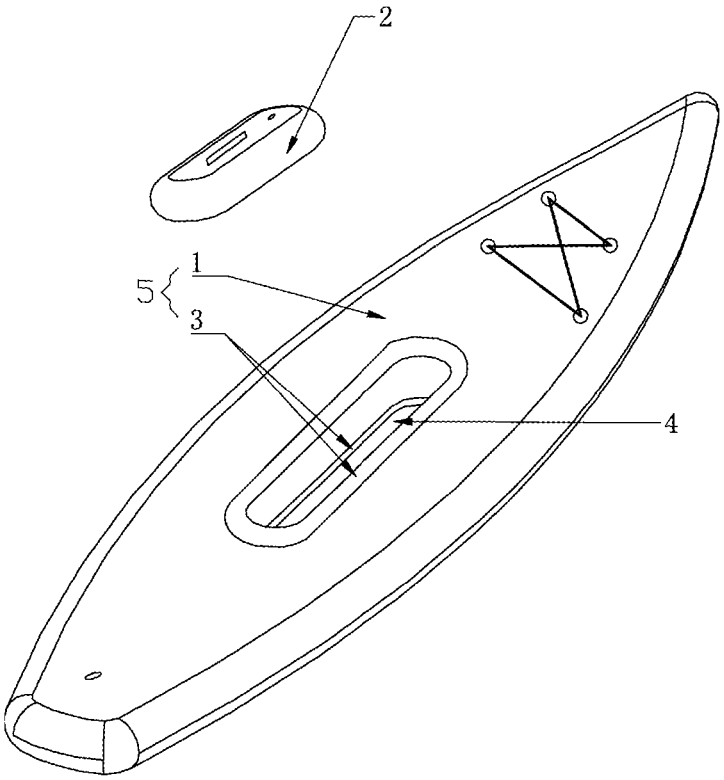
FIG. 2 is a schematic diagram of the double-chamber inflatable paddle board with detachable function in an exploded state in Embodiment 1.

FIG. 1 is a schematic diagram of the double-chamber inflatable paddle board with detachable function in a combined state in this embodiment, and FIG. 2 is a schematic diagram of the inflatable paddle board with two detachable chambers in an exploded state in this embodiment. As shown in FIGS. 1 and 2, the double-chamber inflatable paddle board with detachable function includes an outer chamber 1, an inner chamber 2 and a fixing connector strip 3. The outer chamber 1 and the inner chamber 2 are both independent chambers cut from brushed fabric material. A middle portion of the outer chamber 1 includes an opening with an accommodating cavity 4 that can match and accommodate the inner chamber 2. The inner chamber 2 is detachably connected in the accommodating cavity 4 of the outer chamber 1 through the fixing connector strip 3.

One side of the fixing connector strip 3 is fixedly connected to an inner edge of the outer chamber 1, the other side of the fixing connector strip 3 is suspended and cooperates with the connected chamber to form a snap-fit connection frame 5.

That is, after fixing one side of the fixing connector strip 3 to the inner edge of the outer chamber 1, the other side of the fixing connector strip 3 is unfolded in a flat and straight manner, without showing a "fold down" or "tilt up" shape. Therefore, when the one side of the fixing connector strip 3 is connected to the inner edge of the outer chamber 1 along the edge of the accommodating cavity 4, the other side of the fixing connector strip protrudes from the inner edge of the outer chamber 1, and the fixing connector strip 3 cooperates with the outer chamber 1 to form the snap-fit connection frame 5.

In the inflated state, the other side of the fixing connector strip 3 is engaged on the outer edge of the inner chamber 2, and the outer chamber 1 limits the inner chamber 2 within the accommodating cavity 4 through the other side of the fixing connector strip 3, thus they are matched and formed into an inflatable paddle board product with flat surface. When any of the chambers is deflated, the inner chamber 2 can be easily removed from the inside of the snap-fit connection frame 5, ensuring that if any chamber leaks, this chamber can be directly removed and discarded without affecting the independent use effect of the other chamber.

Figure 3:
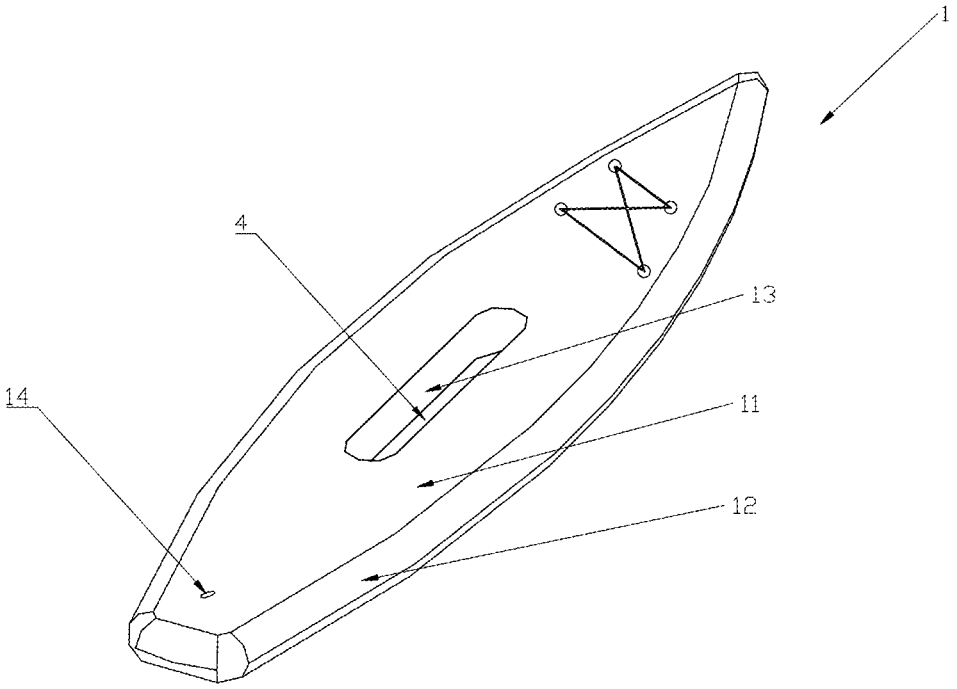
FIG. 3 is a schematic diagram of the overall structure of the outer chamber in Embodiment 1.
Figure 4:
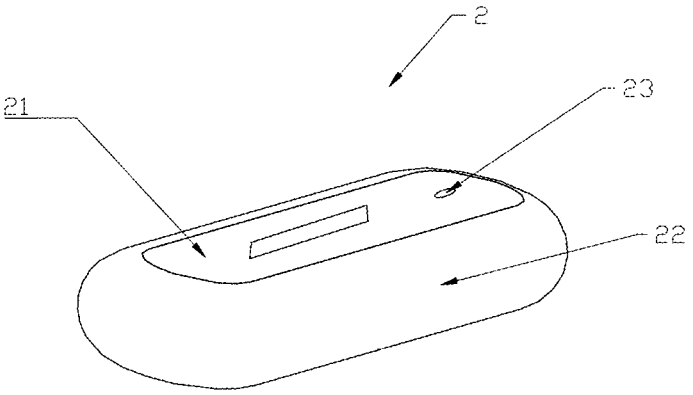
FIG. 4 is a schematic diagram of the overall structure of the inner chamber in Embodiment 1.

Specifically, FIG. 3 is a schematic diagram of the overall structure of the outer chamber in this embodiment, and FIG. 4 is a schematic diagram of the overall structure of the inner chamber in this embodiment. As shown in FIGS. 3 and 4, the outer chamber 1 includes an outer chamber body 11, a first sealing strip 12 and a second sealing strip 13. The periphery sides of the outer chamber body 11 are sealed by the first sealing strip 12, and the inner side of the outer chamber body 11 is sealed by the second sealing strip 13. The outer chamber body 11, the first sealing strip 12 and the second sealing strip 13 together enclose and form an independent chamber with the accommodating cavity 4.

The inner chamber 2 includes an inner chamber body 21 and a third sealing strip 22. The periphery sides of the inner chamber body 21 are sealed by the third sealing strip 22. The third sealing strip 22 is located at the outer edge of the inner chamber 2. The inner chamber body 21 and the third sealing strip 22 together enclose and form an independent chamber. Each of the outer chamber 1 and the inner chamber 2 is a paddle board with an independent chamber. The two independent chambers facilitate independent leak detection in the early stage of production, reducing the leakage defect rate of finished products.

The material of the outer chamber body 11 and the inner chamber body 21 adopts brushed material. In this embodiment, a brushed pad is preferred. The brushed pad is a type of article, in which both the upper and lower surfaces being made from plastic such as soft rubber, the middle portion being made from dense, free and fixed length filaments that connect the soft rubber on the upper and lower surfaces, and the exterior portion being sealed. After inner inflation, the filament structure can ensure the flatness of the two soft rubber surfaces and the overall air pressure resistance strength, Furthermore, it is ensured that when the inner chamber 2 is engaged in the accommodating cavity 4 of the outer chamber 1 by the fixing connector strip 3, the inner chamber 2 can closely fit with the fixing connector strip 3, and there will be no water seepage, leakage, or the like during use.

The preferred material for the first sealing strip 12, the second sealing strip 13 and the third sealing strip 22 is netting fabric. The netting fabric is a fabric product with textile fiber mesh wires mixed in the middle and soft rubber wrapped on soft plastic by thermal pressing on both sides. It is possible to seal the exterior of the brushed pad by thermal pressing or glue.

In some preferred embodiments, the accommodating cavity 4 is a through hollow cavity that runs vertically, and the accommodating cavity 4 is located at the inner edge of the outer chamber 1. The second sealing strip 13 is sealed on the inner side of the outer chamber body 11 along the circumference of the accommodating cavity 4, allowing the inner chamber 2 to be installed vertically in the accommodating cavity 4, and making disassembly easier and manufacturing simplified.

In some preferred embodiments, each of the outer chamber 1 and the inner chamber 2 is provided with an independent air nozzle for independent inflation and deflation through the air nozzle, avoiding mutual influence on each other's usage status and increasing convenience of use.

Specifically, the air nozzles include a first air nozzle 14 and a second air nozzle 23. The first air nozzle 14 penetrates into the chamber of the outer chamber 1, and the second air nozzle 23 penetrates into the chamber of the inner chamber 2. When in use, gas can be respectively filled into each chamber through the first air nozzle 14 and the second air nozzle 23, making the entire chamber full. When not in use, the gas in each chamber can be evacuated through the first air nozzle 14 and the second air nozzle 23, increasing the convenience of use.

In some preferred embodiments, the outer side of the first sealing strip 12 is sleeved with an outer protective strip, which can be connected to the outer side of the first sealing strip 12 by thermal pressing or glue, thereby enhancing side strength of the outer chamber 1, avoiding damage or puncture of the outer side during use, and playing a wear-resistant and protective role.

Figure 5:
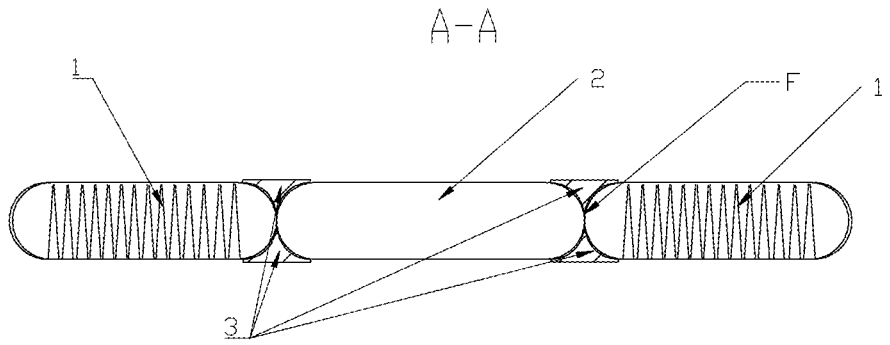
FIG. 5 is a schematic diagram of the section along the A-A direction in FIG. 1.

FIG. 5 is a schematic diagram of the section along the A-A direction in FIG. 1. As shown in FIG. 5, along the outer edge direction of the accommodating cavity 4, one side of the fixing connector strip 3 is annular bonded to the surface of the outer chamber body 11, and the other side of the fixing connector strip 3 is suspended. When the inner chamber 2 is in the inflated state, the other side of the fixing connector strip 3 is engaged on the outer edge of the surface of the inner chamber 2, for detachably connecting the outer chamber 1 and the inner chamber 2 into one piece, thereby constituting a complete paddle board.

In some preferred embodiments, a number of the fixing connector strip 3 is two, and the two fixing connector strips 3 are respectively located in the upper and lower directions of the mating surfaces between the outer chamber 1 and the inner chamber 2, so as to limit the inner chamber 2 into the accommodating cavity 4 through the fixing connector strips 3, increase the stability of the connection and avoid the inner chamber 2 moving up and down relative to the outer chamber 1 due to the influence of force.

Specifically, when the inner chamber 2 is accommodated in the accommodating cavity 4, the outer chamber 1 is flush with the inner chamber 2 at the upper and lower surfaces. The surfaces where the outer chamber 1 and the inner chamber 2 come into contact within the accommodating cavity 4 are the mating surfaces. Along the outer edge direction of the accommodating cavity 4, one side of each of the two fixing connector strips 3 is circularly bonded to the upper and lower surfaces of the inner edge of the outer chamber body 11, and the other side of each of the two fixing connector strips 3 is suspended, so that the two fixing connector strips 3 are respectively located in the upper and lower directions of the mating surfaces between the outer chamber 1 and the inner chamber 2.

When the outer chamber 1 and the inner chamber 2 are connected in the inflated state, the suspended sides of the two fixing connector strips 3 are engaged on the outer edges of the upper and lower surfaces of the inner chamber 2, respectively, so as to limit the inner chamber 2 into the accommodating cavity 4 through the fixing connector strips 3, avoiding the inner chamber 2 moving up and down relative to the outer chamber 1 due to the influence of force.

In some embodiments, it can be imagined that the number of the fixing connector strip 3 is one. For example, the one fixing connector strip 3 is connected to the lower parts of the two chambers, and the upper parts of the two chambers can be detachably connected by means of buttons or overlapping. However, such connection means has poor comfort and safety, and it is not as good as the structure where the fixing connector strips 3 are set in both the upper and lower directions of the chambers. Nevertheless, such arrangement of single fixing connector strip is within the protection scope of the present disclosure.

In some preferred embodiments, the fixing connector strip 3 is made of polyvinyl chloride (PVC) material, and the fixing connector strip 3 is a rigid plastic component with a certain elasticity, so that one side of the fixing connector strip 3 can be bonded to the surface of the outer chamber 1 through polyurethane glue, and the other side of the fixing connector strip 3 can be unfolded straightly in a suspended shape. When the inner chamber 2 accommodated in the accommodating cavity 4 is in the inflated state, the suspended side of the fixing connector strip 3 can be firmly engaged on the outer edge of the surface of the inner chamber 2, and almost no deformation occurs, so as to improve the usage safety of the inflatable paddle board after connecting the outer chamber 1 and the inner chamber 2 into one piece with the request of detachably connecting the outer chamber 1 to the inner chamber 2 being ensured.

In some preferred embodiments, the fixing connector strip 3 has a strip-like structure with a wide top and a thin bottom. The tip of the fixing connector strip 3 is connected to a joint F between the outer chamber 1 and the inner chamber 2, and the top of the fixing connector strip 3 is connected to the surfaces of the outer chamber 1 and the inner chamber 2, enabling the fixing connector strip 3 to provide better support for the chambers, increasing the tightness of the connection between the outer chamber 1 and the inner chamber 2, and preventing the detachment phenomenon between the outer chamber 1 and the inner chamber 2 during normal use.

In some preferred embodiments, the tip of the fixing connector strip 3 can extend along the joint F to a point between the mating surfaces of the outer chamber 1 and the inner chamber 2, so that the tip of the fixing connector strip 3 is tightly pressed between the outer chamber 1 and the inner chamber 2 after assembly. This further increases the firmness of the connection without affecting the overall use effect.

In some preferred embodiments, in the width direction of the fixing connector strip 3, the cross-section of the fixing connector strip 3 is approximate triangle, and the two sides of the fixing connector strips 3 connected to the chambers are in an arc shape, so as to adapt to the arc edge shape of the chambers of the outer chamber 1 and the inner chamber 2 in the inflation state, and to locate the chambers, in turn increase the firmness of the connection between the outer chamber 1 and the inner chamber 2.

The following is a detailed introduction to the double-chamber inflatable paddle board with detachable function of the present disclosure, combined with specific disclosure scenarios.

Along the outer edge direction of the accommodating cavity 4, both the upper and lower surfaces of the outer chamber body 11 are connected with the fixing connector strips 3. One side of the fixing connector strip 3 is circularly bonded to the surface of the outer chamber body 11, and the other side of the fixing connector strip 3 is suspended, thereby the snap-fit connection frame 5 with a through middle portion from top to bottom is constituted.

When in use, when the chambers are in a semi inflated state or a deflated state, the inner chamber 2 is assembled in the accommodating cavity 4 of the outer chamber 1. After assembly, the chambers are inflated separately. As the outer chamber 1 and the inner chamber 2 are independent chambers, the two chambers can be inflated fully independently.

After completing the inflation, the suspended side of the fixing connector strip 3 is engaged on the outer edge of the inner chamber 2, firmly positioning the inner chamber 2 in the middle of the snap-fit connection frame 5.

When any of the chambers experiences air leakage, the leaking chamber will easily detach from the other intact chamber, and the leaking chamber will not become a burden on the other chamber, ensuring the safe buoyancy of the other chamber.

Embodiment 2

Figure 6:
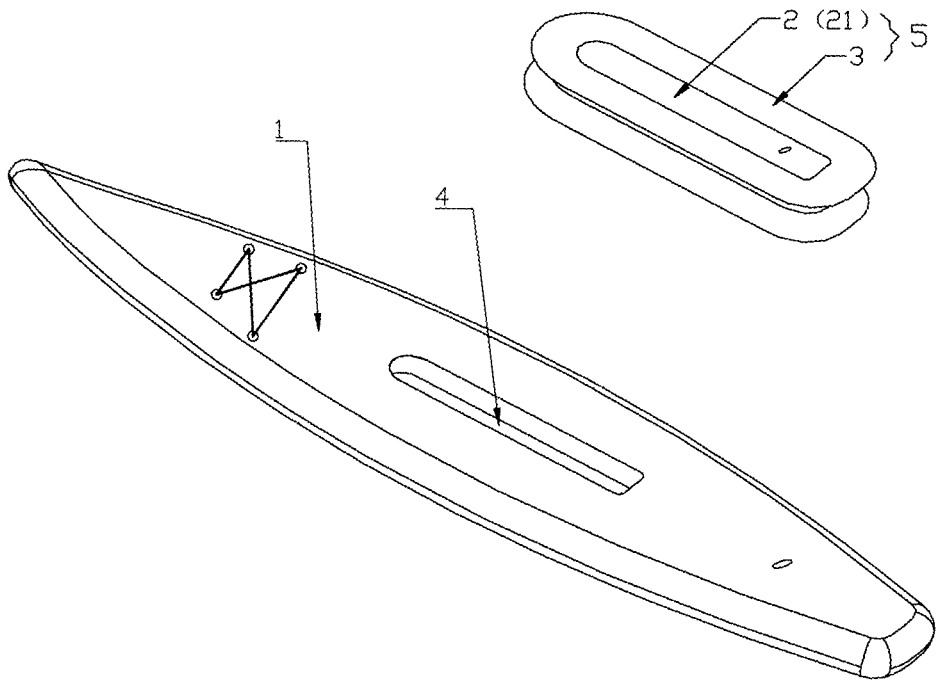
FIG. 6 is a schematic diagram of the double-chamber inflatable paddle board with detachable function in an exploded state in Embodiment 2.

FIG. 6 is a schematic diagram of the double-chamber inflatable paddle board with detachable function in an exploded state in this embodiment. As shown in FIG. 6, the overall structure of this Embodiment 2 is similar to that of Embodiment 1, except: one side of the fixing connector strip 3 is fixedly connected to the outer edge of the inner chamber 2, the other side of the fixing connector strip 3 is suspended, the fixing connector strip 3 cooperates with the inner chamber 2 to form the snap-fit connection frame 5, and the outer chamber 1 is engaged on the outside of the connection frame, so as to achieve a detachable connection between the outer chamber 1 and the inner chamber 2 through the fixing connector strip 3.

In the inflated state, the other side of the fixing connector strip 3 connected to the connection frame is engaged on the inner edge of the outer chamber 1, such that when any chamber leaks, it can be directly removed and discarded without affecting the independent use effect of the other chamber.

Specifically, as shown in FIG. 6, along the outer edge direction of the inner chamber body 21, one side of the fixing connector strip 3 is circularly bonded to the outer edge surface of the inner chamber body 21, and the other side of the fixing connector strip 3 is suspended, constituting the snap-fit connection frame 5 with the exterior thereof in a semi open shape.

When in use, when the chambers are in a semi inflated state or a deflated state, the outer chamber 1 is assembled on outside of the snap-fit connection frame 5. After assembly, the outer chamber 1 and the inner chamber 2 are inflated separately.

After completing the inflation, the suspended side of the fixing connector strip 3 is engaged on the inner edge of the outer chamber 1, firmly positioning the outer chamber 1 on the outside of the snap-fit connection frame 5.

When any of the chambers experiences air leakage, the leaking chamber will easily detach from the other intact chamber, and the leaking chamber will not become a burden on the other chamber, ensuring the safe buoyancy of the other chamber.

In this embodiment, the remaining parts of the outer chamber 1, the inner chamber 2 and the fixing connector strip 3 are structurally identical as that in Embodiment 1. The specific structure has been described in detail in Embodiment 1, and will not be further elaborated in this embodiment.

The above provides a detailed introduction to the specific embodiments of the present disclosure. For those skilled in the art, without departing from the principles of the present disclosure, several improvements and modifications can be made to the present disclosure, which also fall within the scope of protection of the claims of the present disclosure.

What is claimed is:

1. A double-chamber inflatable paddle board with detachable function, comprising an outer chamber, an inner chamber and a fixing connector strip, wherein the outer chamber and the inner chamber are both independent chambers, a middle portion of the outer chamber includes an opening with an accommodating cavity that matches the inner chamber, the inner chamber is detachably connected to the outer chamber through the fixing connector strip;

wherein one side of the fixing connector strip is fixedly connected to one of an inner edge of the outer chamber and an outer edge of the inner chamber, the other side of the fixing connector strip is suspended and cooperates with the connected chamber to form a snap-fit connection frame, in an inflated state, the other side of the fixing connector strip is engaged on one of the outer edge of the inner chamber and the inner edge of the outer chamber, and wherein the fixing connector strip has a strip-like structure with a wide top and a thin bottom, a tip of the fixing connector strip is connected to a joint (F) between the outer chamber and the inner chamber, and the top of the fixing connector strip is connected to surfaces of the outer chamber and the inner chamber.

2. The double-chamber inflatable paddle board with detachable function of claim 1, wherein in a width direction of the fixing connector strip, a cross-section of the fixing connector strip is approximate triangle, and two sides of the fixing connector strip connected to the chambers are in an arc shape.

3. The double-chamber inflatable paddle board with detachable function of claim 1, wherein a number of the fixing connector strip is two, and the two fixing connector strips are respectively located in upper and lower directions of mating surfaces between the outer chamber and the inner chamber.

4. The double-chamber inflatable paddle board with detachable function of claim 1, wherein the fixing connector strip is made of polyvinyl chloride material.

5. The double-chamber inflatable paddle board with detachable function of claim 1, wherein the outer chamber includes an outer chamber body, a first sealing strip and a second sealing strip, periphery sides of the outer chamber body are sealed by the first sealing strip, an inner side of the outer chamber body is sealed by the second sealing strip, the outer chamber body, the first sealing strip and the second sealing strip together enclose and form an independent chamber with the accommodating cavity.

6. The double-chamber inflatable paddle board with detachable function of claim 5, wherein the accommodating cavity is a through hollow cavity that runs vertically, and the second sealing strip is sealed on the inner side of the outer chamber body along a circumference of the accommodating cavity.

7. The double-chamber inflatable paddle board with detachable function of claim 1, wherein the inner chamber includes an inner chamber body and a third sealing strip, periphery sides of the inner chamber body are sealed by the third sealing strip, the inner chamber body and the third sealing strip together enclose and form an independent chamber.

8. The double-chamber inflatable paddle board with detachable function of claim 7, wherein the accommodating cavity is located at the inner edge of the outer chamber, and the third sealing strip is located at the outer edge of the inner chamber.

9. The double-chamber inflatable paddle board with detachable function of claim 1, wherein each of the outer chamber and the inner chamber is provided with an independent air nozzle.

* * * * *